United States Patent [19]

Moriarity

[11] Patent Number: 4,765,488

[45] Date of Patent: Aug. 23, 1988

[54] APPARATUS FOR SORTING ITEMS ACCORDING TO DETACHABLE CHARACTERISTICS

[76] Inventor: Larry J. Moriarity, 1339 Hampton Hall Dr., Atlanta, Ga. 30319

[21] Appl. No.: 875,074

[22] Filed: Jun. 17, 1986

[51] Int. Cl.[4] ..... B07C 5/30; B07C 5/36

[52] U.S. Cl. ..... 209/551; 177/123; 177/211; 198/371; 198/502.1; 198/505; 209/593; 209/606; 209/925; 209/933; 364/478

[58] Field of Search ..... 209/546, 549, 551, 563–566, 209/592–596, 606, 645, 646, 651–654, 706, 917, 925, 933, 942; 198/502.1, 504, 505, 371; 177/25.18, 59, 123, 211; 364/478, 567

[56] References Cited

U.S. PATENT DOCUMENTS

| | | | |
|---|---|---|---|
| Re. 15,626 | 6/1923 | Plonka | 198/371 |
| 1,496,376 | 6/1924 | Poore . | |
| 1,923,009 | 8/1933 | Miller et al. | 209/594 |
| 1,927,217 | 9/1933 | Price . | |
| 2,435,706 | 2/1948 | Barker . | |
| 2,664,557 | 12/1953 | Sargrove . | |
| 2,732,067 | 1/1956 | Cunningham, Sr. et al. | 209/606 X |
| 2,759,603 | 8/1956 | Bradley | 209/594 |
| 2,827,058 | 3/1958 | Bogaty | 198/371 X |
| 2,962,166 | 11/1960 | Miles et al. . | |
| 2,981,412 | 4/1961 | McQueen et al. . | |
| 3,017,027 | 1/1962 | Brown et al. . | |
| 3,348,678 | 10/1967 | Flowers | 209/595 |
| 3,627,127 | 12/1971 | Whiteford | 209/566 |
| 3,643,798 | 2/1972 | Krupotich | 209/593 |
| 3,677,401 | 7/1972 | Chaparro et al. . | |
| 3,857,488 | 12/1974 | Le Cren | 177/211 X |
| 4,024,053 | 5/1977 | Drew, Jr. et al. | 209/593 |
| 4,135,615 | 1/1979 | Brackmann et al. | 198/371 |
| 4,253,573 | 3/1981 | Dubberly et al. | 209/925 X |
| 4,413,739 | 11/1983 | Kohashi | 209/593 |
| 4,450,073 | 5/1984 | Burnett et al. . | |
| 4,531,597 | 7/1985 | Focke et al. | 177/123 X |

FOREIGN PATENT DOCUMENTS

| | | | |
|---|---|---|---|
| 0957793 | 2/1957 | Fed. Rep. of Germany | 209/592 |
| 1156546 | 10/1963 | Fed. Rep. of Germany | 209/606 |
| 2448944 | 10/1980 | France | 209/942 |
| 0442856 | 7/1975 | U.S.S.R. | 209/592 |

*Primary Examiner*—Robert B. Reeves
*Assistant Examiner*—Edward M. Wacyra
*Attorney, Agent, or Firm*—Dority & Manning

[57] ABSTRACT

A sorting apparatus for sorting items according to weight or other measurable characteristics. An elongated conveyor feeds the items to be sorted to a combined weighing and conveying mechanism, which after weighing the item, is driven in one direction or another to drop the item weighed onto a uni-directionally driven conveyor. The unidirectionally driven conveyor transports the item it receives and deposits it onto a bi-directionally driven conveyor. The bi-directionally driven conveyor is then driven in the necessary direction to transport the item it receives and to deposit it onto a selected bi-directionally driven conveyor. This bi-directionally driven conveyor, in turn, is selectively driven to cause the item it receives to be deposited into the indicated receiver for items of weight corresponding thereto. Thus, any items deposited onto the combined weighing and conveying mechanism will automatically be transported to the appropriate receiver in accordance with the weight of the items detected by the weighing mechanism. In an alternative embodiment, the bi-directionally driven conveyor is replaced with a bi-directionally driven weigh block. This block is generally square with four concave surfaces and is adapted to receive items from the supply conveyors and to weigh those items and to cause the weigh block to rotate ninety degrees in either one direction or the other depending on the weight of the item, deposits the item weighed onto the appropriate conveyor.

19 Claims, 7 Drawing Sheets

FIG. 2
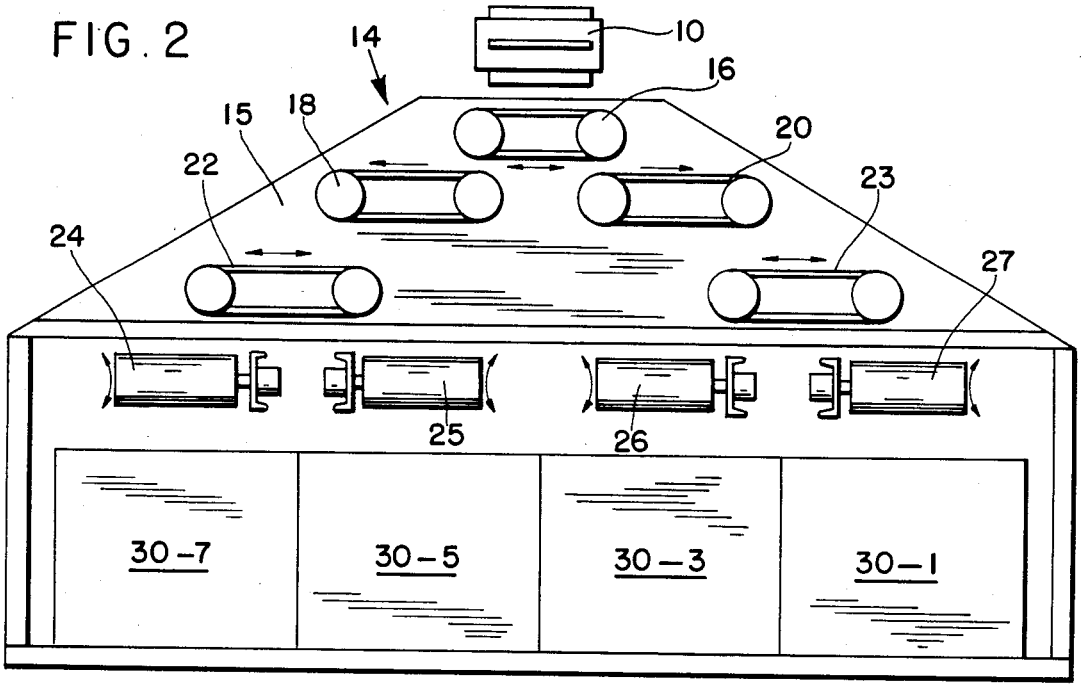
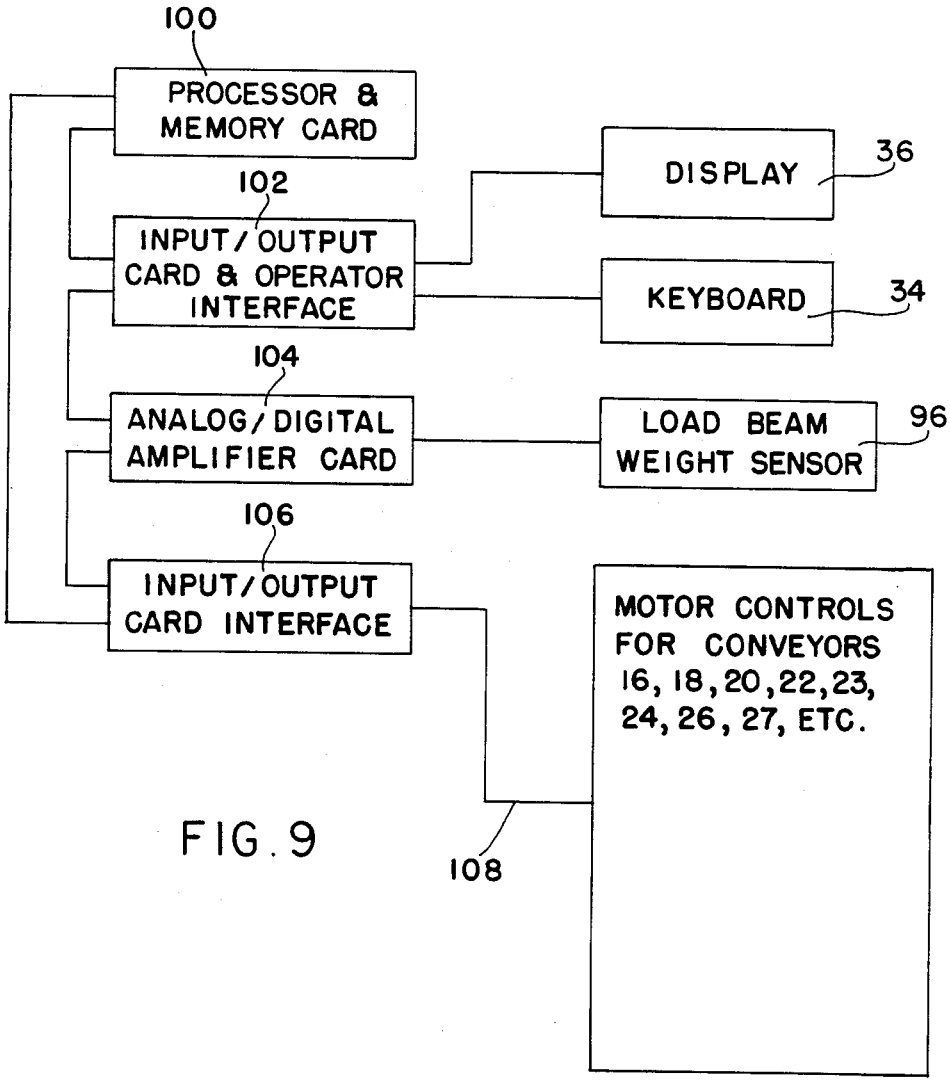
FIG. 9

APPARATUS FOR SORTING ITEMS ACCORDING TO DETACHABLE CHARACTERISTICS

BACKGROUND OF THE INVENTION

Heretofore, in many poultry processing plants, pieces of poultry, such as chicken were either not sorted by weight or were manually sorted.

It has been more popular in recent years to sell cooked chicken based on the price per piece. For example, oftentimes, a chicken dinner will include two or three pieces of chicken along with a potato and a vegetable. When a merchant of cooked chicken purchases a chicken, he purchases a chicken based on the price per pound of chicken. When selling this chicken however, it is desirable that the particular pieces of chicken be the same weight so that he can determine the exact price he must sell the pieces of chicken for in order to make a profit. Accordingly, it is desirable to have the chicken parts separated according to weight ranges.

Other industries have similar problems in selling and pricing particular items such as fruit, etc., and it is desirable that the items of a particular weight range be inserted in a particular receiver or bin. Examples of patents showing sorting devices are U.S. Pat. Nos. 2,759,063 and 1,496,376 which disclose sorting devices upon which items are sorted between different channels responsive to the weight of the item. Positioned between the various channels is a conveyor which transports the articles through the guide channels. Examples of other sorting devices are shown in the following U.S. Pat. Nos.: 1,927,217, 2,435,706, 2,664,557, 2,962,166, 2,981,412, 3,017,027, 3,677,401, 4,413,739, and 4,450,073. These patents were located during a search of the records of the United States Patent Office.

SUMMARY OF THE INVENTION

The apparatus constructed in accordance with the present invention is for sorting items according to weight and/or other measurable criteria and includes a measuring apparatus such as a weighing mechanism, that is positioned at the end of one or more elongated feeding conveyors which feeds items that are to be sorted according to weight or other measurable characteristics successively to the weighing or measuring mechanism. As the items drop off the end of one or more feeding conveyors, the fall onto the weighing mechanism which weighs the particular item and produces an analog signal which corresponds to the weight of the item. This analog signal is fed to a computer which converts the analog signal to a digital signal. The computer has associated therewith a keyboard and a display panel. It is capable of being programmed to produce signals representing various discrete limits into which the items are to be separated. These weight limits, of course, can be modified by an operator manipulating the keyboard. The computer, in turn, generates signals for transporting the item from the weighing mechanism and for controlling a number of bi-directionally driven conveyor belts for directing the item to the particular specific predetermined receiver designated for items having the characteristics measured.

A distributor is positioned adjacent the weighing mechanism. The distributor comprises a plurality of bi-directionally driven conveyors which are selectively driven in response to the digital signal generated by the computer in response to the weight measured by the detector. A plurality of receivers are carried below the distributor for receiving the items sorted by the distributor. The bi-directionally driven conveyors are driven in selective directions in response to the digital signal generated by the computer to direct the item detected or measured along a predetermined path to deposit said item into the appropriate receiver.

Accordingly, it is an important object of the present invention to provide an apparatus for sorting items according to weight or other measurable characteristics which is simple in operation.

Another important object of the present invention is to provide an apparatus which will sort items according to weight and automatically transport such items to the appropriate receivers under the control of a computer.

Still another important object of the present invention is to provide a weighing or measuring mechanism in combination with a distributor for transporting or directing items successively through a distributor according to predetermined sorting paths determined by the weight of the item.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming an integral part thereof, wherein an example of the invention is shown and wherein:

FIG. 2 is a front diagramatic view of the distributor utilized with the invention;

FIG. 9 is a block diagram illustrating the computer, the weight detector and the control for the distributor utilized in all embodiments of the invention;

Referring now to FIGS. 1 and 2 of the drawings, there is illustrated an elongated conveyor 10 that has a surface for transporting items such as pieces of chicken to a distributor generally designated by the reference character 14. Conveyor 10 is supported by the distributor frame member or plate 15 and frame member 12 of the sorting apparatus. Conveyor 10 may be driven by any suitable mechanism such as by an electric motor or drive, not shown in the drawings, and operates to feed items to conveyor 16 when proximity sensor 13 detects an item in position to be dropped onto conveyor 16. Sensor 13 sends a signal to the computer (to be described later) and the computer stops conveyor 10 until the previous item has had time to clear conveyor 16.

Figure 8:
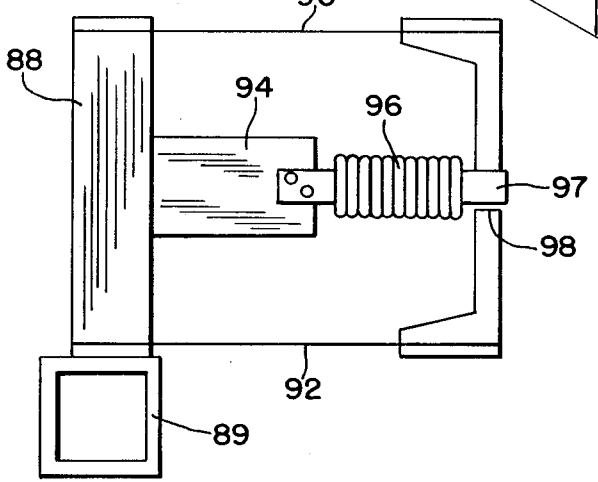
FIG. 8 is a detailed side view illustrating the weight detector utilized by the combined weight detector and conveyor of FIG. 6.
Figure 6:
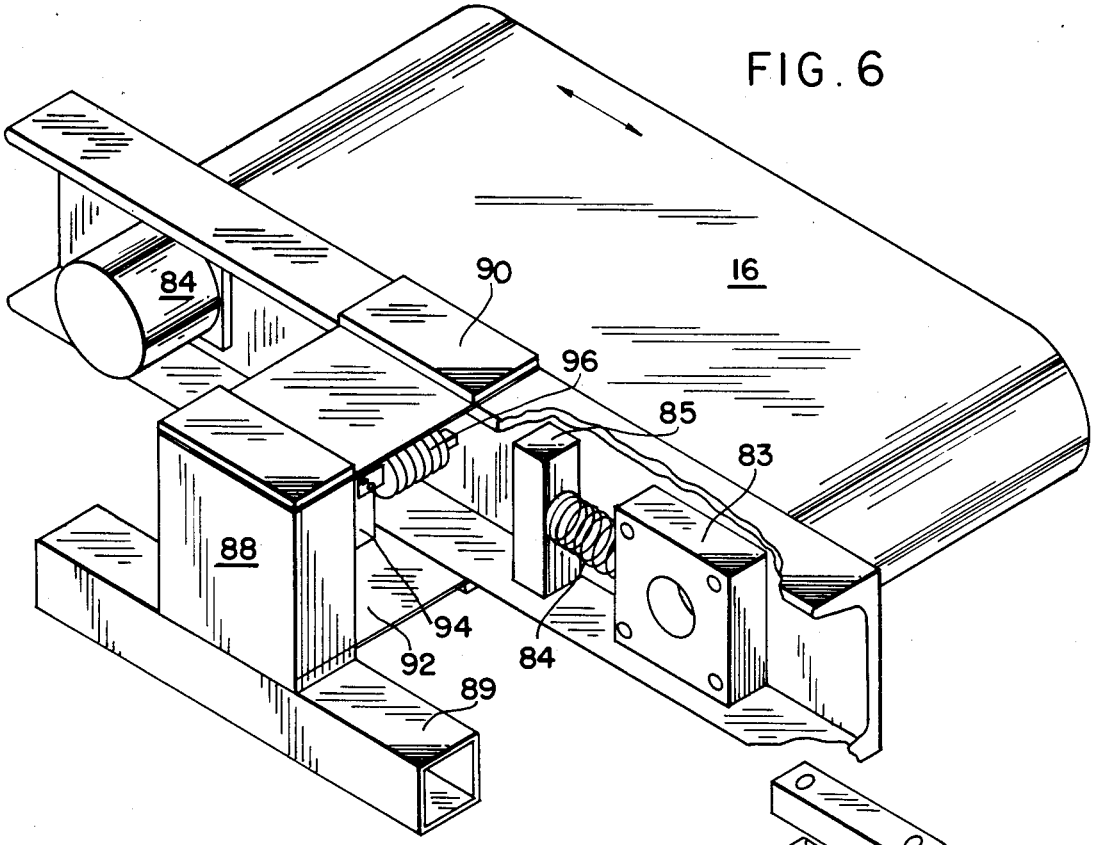
FIG. 6 is an enlarged perspective view illustrating the combined weight detector and conveyor utilized with the invention.
Figure 7:
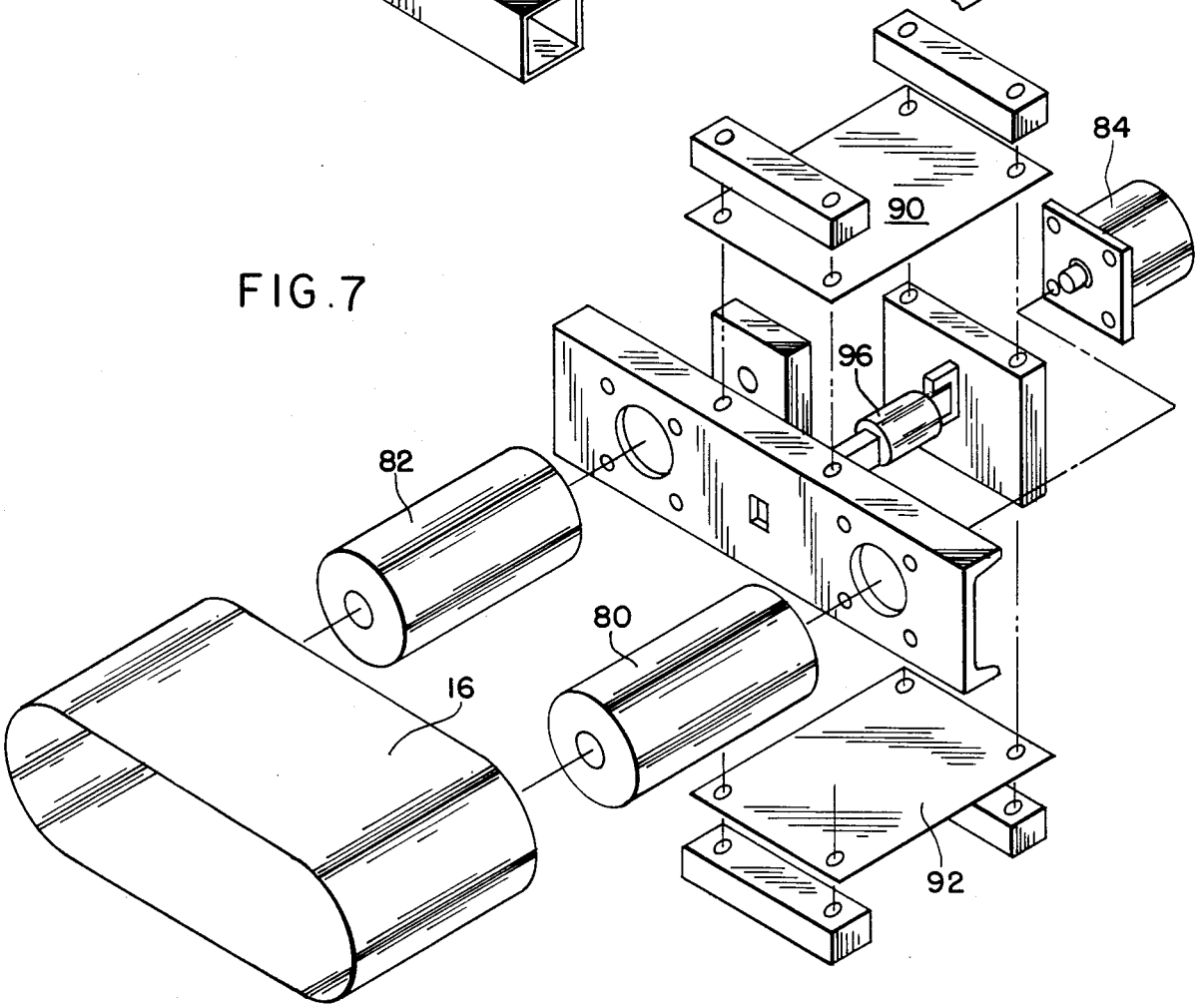
FIG. 7 is an exploded perspective view illustrating the combined weight detector and conveyor shown in FIG. 6.

As the items are fed to the distributor end of the conveyor, they are dropped onto a bi-directiorally driven conveyor 16 which also contains a mechanism for weighing the items. Details of conveyor 16 and its associated weight detector are illustrated in FIGS. 6, 7 and 8 of the drawings and will be discussed in detail hereinafter. At this point it is sufficient to note that conveyor 16 weighs the items deposited thereon and generates a signal indicative of the weight of the item. The signal generated is an analog signal which is transmitted to a computer in console 32, as will be described in more detail in connection with FIG. 9 of the drawings hereinafter.

The computer in console 32, in turn, generates signals which control the several bi-directionally driven conveyors of the distributor as will be described hereinafter. This signal operates the drive for bi-directionally driven conveyor 16 to drive it in either one direction or the other depending on the weight of the item deposited thereon. In turn, conveyor 16 deposits or drops the item onto uni-directionally driven conveyor 18 or 20, again, depending upon the weight of the item deposited on conveyor 16. Conveyors 22 and 23 are bi-directionally driven, again, in accordance with the signals generated by the computer in console 32 in response to the weight of the item detected by bi-directionally driven conveyor 16. Items deposited upon bi-directionally driven conveyors 22 or 23 will, in turn, be deposited upon either of their associated bi-directionally driven conveyors 24 and 25 in the case of conveyor 22, or 26 and 27 in the case of conveyor 23. Each of bi-directionally driven conveyors 24, 25, 26 and 27 are associated with two receivers. The receivers are designated by reference characters 30-1 through 30-8, there being a total of eight receivers in this embodiment of the apparatus.

The operation of the apparatus of FIGS. 1 and 2 will now be described in detail with refererce to a specific item deposited onto bi-directionally driven conveyor 16. The item in question is deposited onto conveyor 16 which immediately senses the weight of the item and transmits a signal to console 32. The computer in console 32 then generates signals for the drives of the bi-directionally driven conveyors of the distributor. For example, assume that the item in question is intended to be deposited in receiver 30-1. In this case, conveyor 16 is driven in a direction to deposit the item onto conveyor 20. Conveyor 20 is driven in a single direction, continuously when the apparatus is operating and, in turn, deposits the item in question onto conveyor 23, which is bi-directionally driven. In this case, however, the computer in console 32 has generated a signal causing conveyor 23 to be driven to deposit the item in question onto bi-directionally driven conveyor 27. At the same time, the computer in console 32 has generated a signal which will cause conveyo 27 to operate to deposit the item in question into receiver 30-1.

In practice with multiple items being transported through the distributor at the same time, the computer directs the distributor as follows: the computer directs conveyor 10 to deliver an item onto weight conveyor 16. The item is weighed and the computer selects the receiver for the item weighed. This operation takes only about 0.5 seconds or less. The computer drives conveyor 16 in the direction necessary to send the item to the receiver selected. As soon as conveyor 16 is clear, another item is dropped onto conveyor 16 by conveyor 10 and weighed by it. The computer then starts the second items on its way to the appropriate receiver. During the time each item is moving through the distributor, the computer will track them and turn on and off the appropriate conveyor motors to direct each item to the selected receiver. This requires the computer to know when each of the items have arrived on the appropriate conveyors. This is presently accomplished by driving each conveyor a predetermined length of time sufficient to deliver the item to the next conveyor The computer causes each of the conveyors to be driven in the necessary direction for the selected time to deliver its item to the next conveyor.

Alternately, each of the conveyors may be equipped with proximity sensors at each end of the bi-directionally driven conveyors and at the delivery end of the uni-directionally driven conveyors which will send a signal to the computer when each conveyor has delivered its item to the next conveyor or to its receiver.

From this example, it will readily be apparent that the computer in console 32 can be programmed by the apparatus operator, as will be described in more detail hereinbelow, in connection with FIG. 9, to produce signals in response to predetermined weight limits so that the items deposited onto bi-directionally driven conveyor 16 may be directed to any one of receivers 30-1 through 30-8 as desired. The operator of the machine can program the computer through keyboard 34 to provide predetermined weight limits for each of the receivers and the display panel 36 may display on command the weight of articles in each of the receivers at any time, when commanded to do so by the operator, in a manner which will be described in more detail in connection with FIG. 9 hereinbelow.

Figure 3:
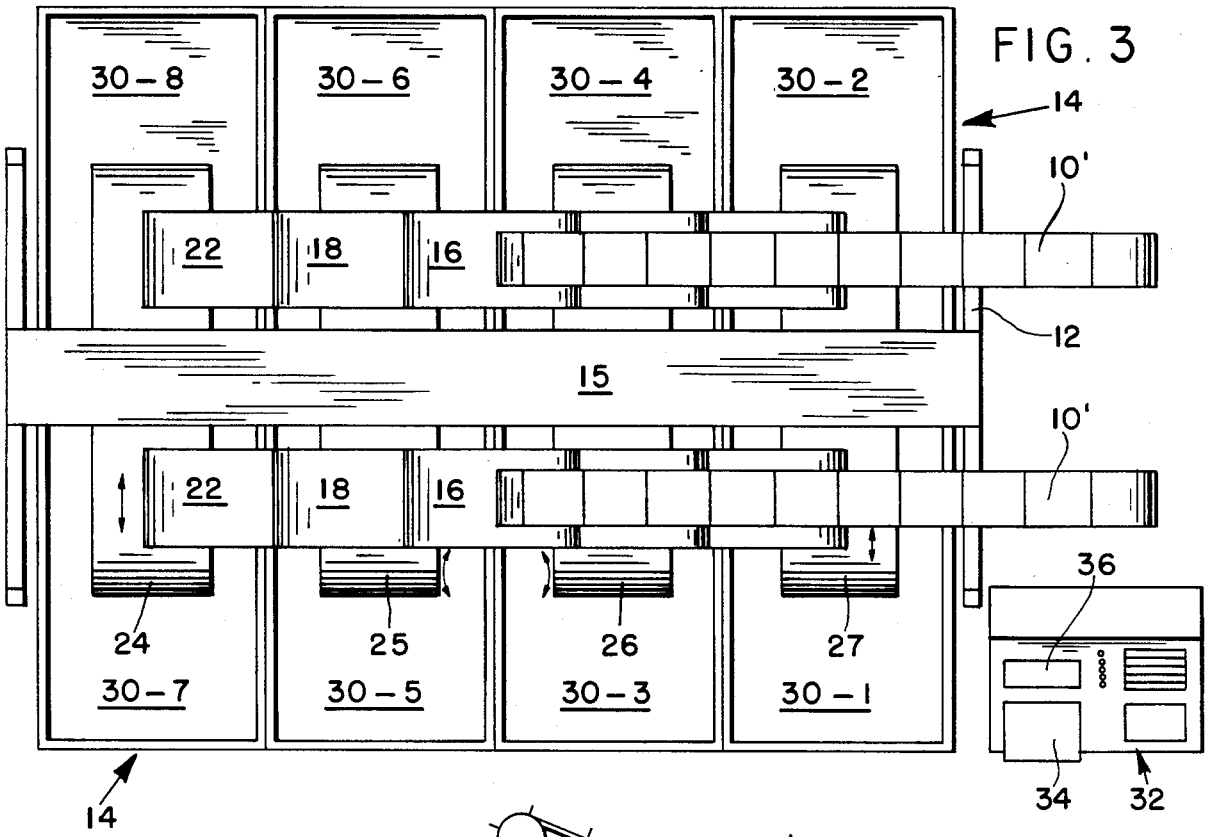
FIG. 3 is a diagramatic plan view illustrating a second embodiment of apparatus constructed in accordance with the present invention.
Figure 4:
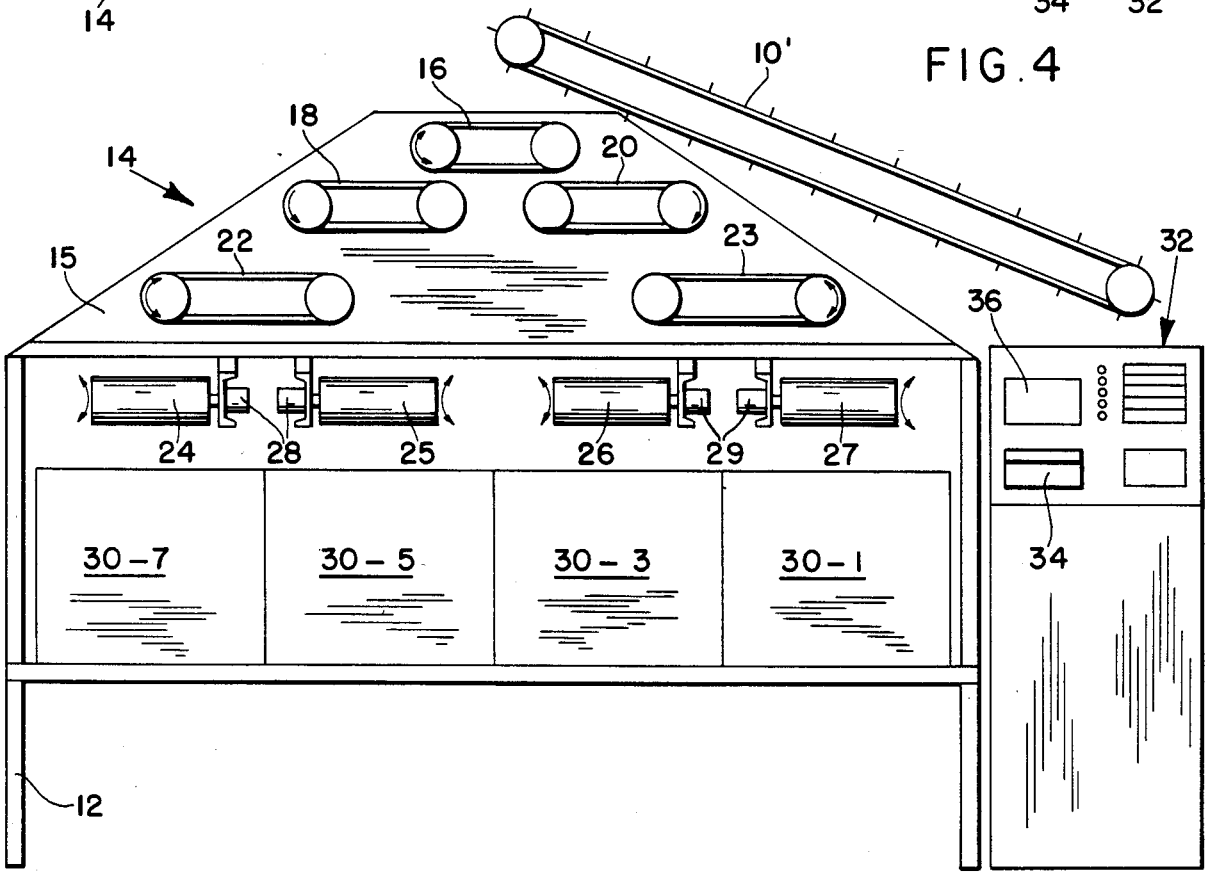
FIG. 4 is a side view of the apparatus illustrated in FIG. 3.

Referring now to FIGS. 3 and 4 wherein there is illustrated a second embodiment of apparatus according to the invention. In this embodiment, the apparatus is provided with two feed conveyors 10'. Each of conveyors 10' transports its items to a separate distributor 14 similar to that described in FIG. 1. In this particular embodiment, items deposited onto conveyor 16 are automatically weighed, as described with regard to FIG. 1, and a signal is generated and fed to console 32 which, in turn, will generate a signal that will activate or drive conveyor 16 to deposit the item on either of uni-directionally driven conveyors 18 or 20, depending on the receiver for which such items are intended. The computer in console 32 will also generate and transmit signals to drive either bi-directionally driven conveyors 22 or 23 in the appropriate direction to deposit such items onto one or the other of their associated bi-directionally driven conveyors 24, 25 in the case of conveyor 22, or 26 and 27 with respect to conveyor 23.

Thus, an item initially fed by conveyor 10' onto the distributor on the odd numbered receivers side may, in fact, be transported to an even numbered receiver on the opposite side of the apparatus depending on its weight. Accordingly, items of mixed weights can be fed by both of the conveyors 10' in this embodiment for either odd or even numbered receivers. For example, suppose that an item designated for receiver 30-8 is fed onto the odd sided conveyor 10', this item would, in turn, be deposited onto conveyor 16 and an appropriate signal would be generated to have the item conveyed from conveyor 16 to conveyor 18 and, thence, to conveyor 22. Conveyor 22 would then be driven to deposit the item designated for receiver 30-8 onto conveyor 24. Conveyor 24, in turn, would be driven to deposit the item in receiver 30-8. Accordingly, items originally fed on the even side conveyor 10' can be delivered to any of receivers 30-1 through 30-8.

In view of the fact that conveyors 24, 25, 26 and 27 service both odd and even sided receivers from each of the distributors on the opposite sides of the apparatus, approximately six percent of the time, two items will be deposited on one of the conveyors 24, 25, 26 and 27 which are intended to be deposited in each of the receivers on the odd and the even side. In this case, a contention occurs and the computer is programmed to cause the second item to wait until the other item has cleared the respective common conveyors. For example, whenever there are two items designated to be deposited into receivers 30-7 and 30-8 at substantially the same time, the computer automatically delays the transport of the second item until the other is cleared from its conveyor 24, so as to assure that each item is deposited into its appropriate receiver.

Figure 5:
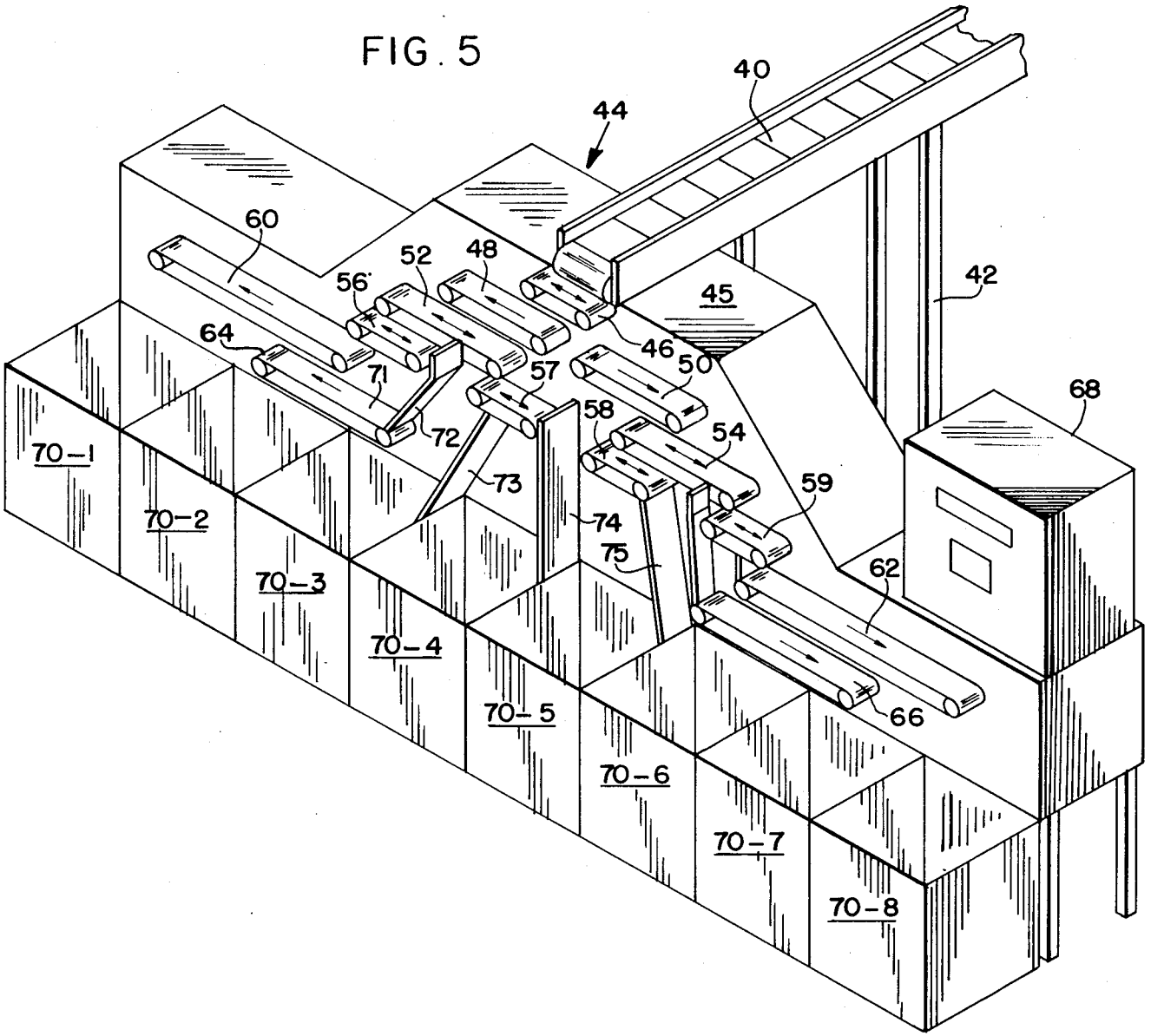
FIG. 5 is a perspective view illustrating a third embodiment of apparatus constructed in accordance with the present invention.

A third embodiment of the apparatus of the invention is illustrated in FIG. 5 of the drawings. In this embodiment, receivers 70-1 through 70-8 are arranged in a single line. Items to be sorted are fed to a distributor 44 by a conveyor 40 which is supported by frame member 42 and distributor frame 45. In this embodiment, bi-directionally driven conveyor 46 corresponds to conveyor 16 of FIGS. 1–4. Conveyor 46 weighs the items deposited thereon by conveyor 40 and generates a signal indicative of the weight of the item detected and transmits this signal to console 68. As described above with regard to FIGS. 1–4, console 68 includes a computer which generates signals to cause the various conveyors of distributor 44 to be driven in directions which will transport items in question to the appropriate receiver for which they are intended. In this embodiment, conveyors 48 and 50 are driven unidirectionally in opposite directions and conveyors 52, 54, 56, 57, 58 and 59 are driven bi-directionally depending upon the destination of items deposited thereon. Conveyors 60, 62, 64, and 66 are driven unidirectionally to transport articles deposited thereon to the receivers associated with these conveyors. For example, conveyor 60 will deposit all items it receives into receiver 70-1. Conveyor 64 will deposit all items it receives into receiver 70-2.

Conveyor 56 has associated with it a pair of fixed guides 71 and 72. These guides are to assure that items deposited onto conveyor 56 will be directed either onto conveyor 60 or 64. Conveyor 57 has associated with it fixed guides 73 and 74. This is to assure that items deposited onto conveyor 57 are directed to either receiver 70-3 or 70-4 as intended. Conveyor 58 is associated with fixed guides 74 and 75 which, in turn, assure that items deposited onto conveyor 58 will be directed to either receiver 70-5 or 70-6, as intended. Conveyor 59 has associated with it, fixed guides 76 and 77, which assure that all items deposited onto conveyor 59 are directed onto conveyors 62 or 66, as intended, for further deposit either into receiver 70-7 or 70-8 as intended.

In this embodiment, an item is deposited onto conveyor 46, which weighs the item and generates a signal which is transmitted to the computer in console 68. The computer in console 68, in turn, generates a signal that is transmitted to the drives of the appropriate conveyors of the distributor to direct the item weighed or detected on conveyor 46 to the appropriate receiver for which such items are designated. For example, assume that an item is deposited onto conveyor 46 which is intended to be deposited into receiver 70-8. In this case, conveyor 46 will be driven to deposit the item in question onto uni-directionally driven conveyor 50. Uni-directionally driven conveyor 50 deposits the item onto bi-directionally driven conveyor 54. The signal generated by the computer causes conveyor 54 to deposit the item requested onto conveyor 59. Conveyor 59 is, in turn, driven to deposit the item in question onto uni-directionally driven conveyor 62. All items deposited onto conveyor 62 are then transported to receiver 70-8.

Referring now to FIGS. 6, 7 and 8, which illustrate a weight detector mechanism for use with each of the embodiments of the invention. This weight detector is combined with bi-directionally driven conveyor 16, as noted previously. Conveyor 16 is supported by a driven pulley 80 and an idler pulley 82. The driven and idler pulleys are supported on a channel mounting member 86. Driven pulley 80 is driven bi-directionally by drive motor 81 and idler pulley 82 is mounted in idler pulley mounting block 83. Mounting block 83 is urged away from the driven pulley 80 and a fixed block 85 by tension spring 84 so as to maintain tension on conveyor belt 16.

The channel mounting member 86 is supported from support block 88 by means of upper flexure plate 90 and lower flexure plate 92. Flexure plates 90 and 92 are chosen to support the weight of the driven and idler pulleys and the associated mechanism for conveyor belt 16. Support block 88, in turn, is supported by machine frame member 89. A load block 94 is mounted onto support block 88 at one end and, at its other end, load block 94 is an integral part of, and supports a load beam 96, which carries at its opposite end, a load bar 97. Load bar 97 extends through an opening 98 in channel mounting member 86.

Whenever an item is placed onto conveyor 16, the weight of such item deflects the upper and lower flexure plates and deflects load beam 96 and causes it to generate a signal which corresponds to the weight of the item placed onto conveyor 16. The signal generated by load beam 96 is fed into a computer in the console as described previously.

Referring now in more detail to FIG. 9 of the drawings, there is a block diagram illustrating the controls for the sorting apparatus of the invention. Console 32, shown diagrammatically in FIG. 1, is positioned adjacent the sorting apparatus of the invention and includes a key board 34 and a display panel 36. An operator, by manipulating the key board, can program a computer carried within the console to set the various weight ranges into which the items are to be sorted. The computer includes a processor and memory card 100 into which the information regarding the sorting is programmed. The computer also includes an input-output card and operator interface 102, an analog-to-digital amplifier card 104, and an input-output card interface 106.

The weight sensor or load beam 96 generates an analog signal indicating the weight of the item deposited onto conveyor 16. This analog signal is fed to the analog/digital card 104, which converts the signal received into a digital signal that is fed to the processor and memory card 100 via a computer buss. The weight of the item on conveyor 16 is displayed on the display panel 36. The processor card is also programmed to totalize the weight of the items weighed on conveyor 16 which is also displayed on display panel 36. The processor card, in some instances, is programmed to indicate the total weight of the items deposited in a respective receiver. The programming of the computer can be carried out in any suitable conventional manner for displaying information such as the number of items weighed, the particular receivers that the items are deposited into, the total weight, the weight of the particular items being weighed, etc.

The processor and memory card 100 generates a signal that is fed through the input/output card 102 for generating a plurality of signals in parallel form on its output terminals. When the input/output card is used for driving conveyors 16, 18, 20, 22, 23, 24, 25, 26 and 27, nine pairs of outputs are used. The first output pair is directed to bi-directionally driven conveyor 16, and more particularly to the bi-directional drive motor 81 for conveyor 16. This signal causes conveyor 16 to be driven in the appropriate direction to deposit the item thereon onto either conveyor 18 or conveyor 20, as the case may be. Similarly other signals are fed over output lines 108 to cause the conveyors of the distributor to be driven in appropriate directions to carry the item in question to the receiver for which it is intended.

It is to be understood, of course, that in normal operations, when no signal is transmitted to the drive motors for the conveyors the conveyors are at rest and will operate only upon receipt of the appropriate signals from the computer.

Figure 1:
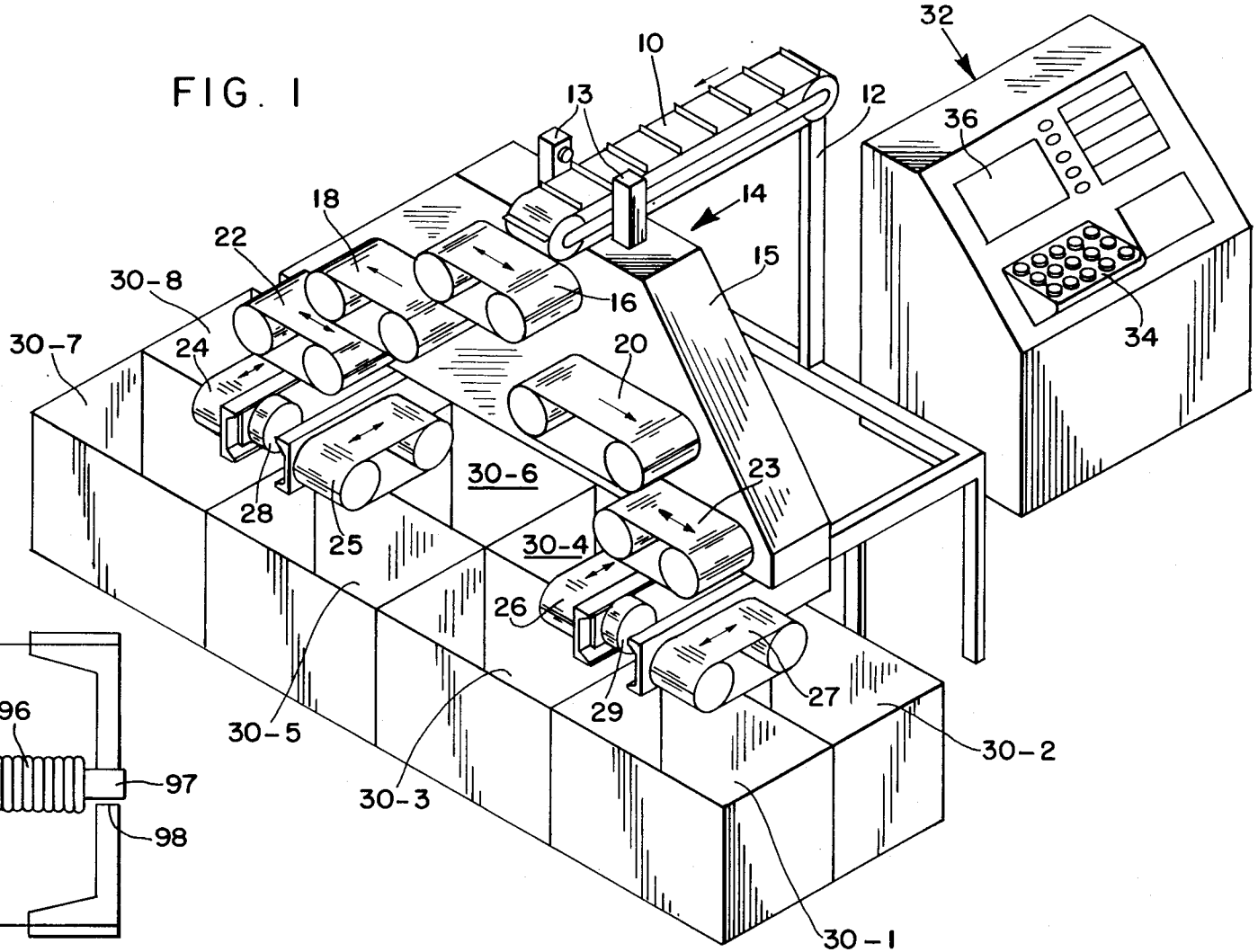
FIG. 1 is a perspective view illustrating an apparatus constructed in accordance with the present invention.

When the weight of a particular item comes within the range set for receiver 30-1 of the embodiment shown in FIGS. 1 and 2, the output signals of the computer will cause conveyor 16 to operate to deposit the item thereon onto conveyor 20. Conveyor 20, in turn, is driven only in one direction and deposits the items it receives, from conveyor 16, onto conveyor 23. Conveyor 23 will be driven in the direction to deposit the item it receives from conveyor 20 onto conveyor 27. Conveyor 27 will be driven in a direction to deposit the item it receives from conveyor 23 into receiver 30-1. By generating different signals in response to the weight detected by detector 16, different signals will be transmitted to the bi-directional motor drives for the conveycrs of the distributor to cause the item in question to be deposited in any of the receivers desired.

Figure 10:
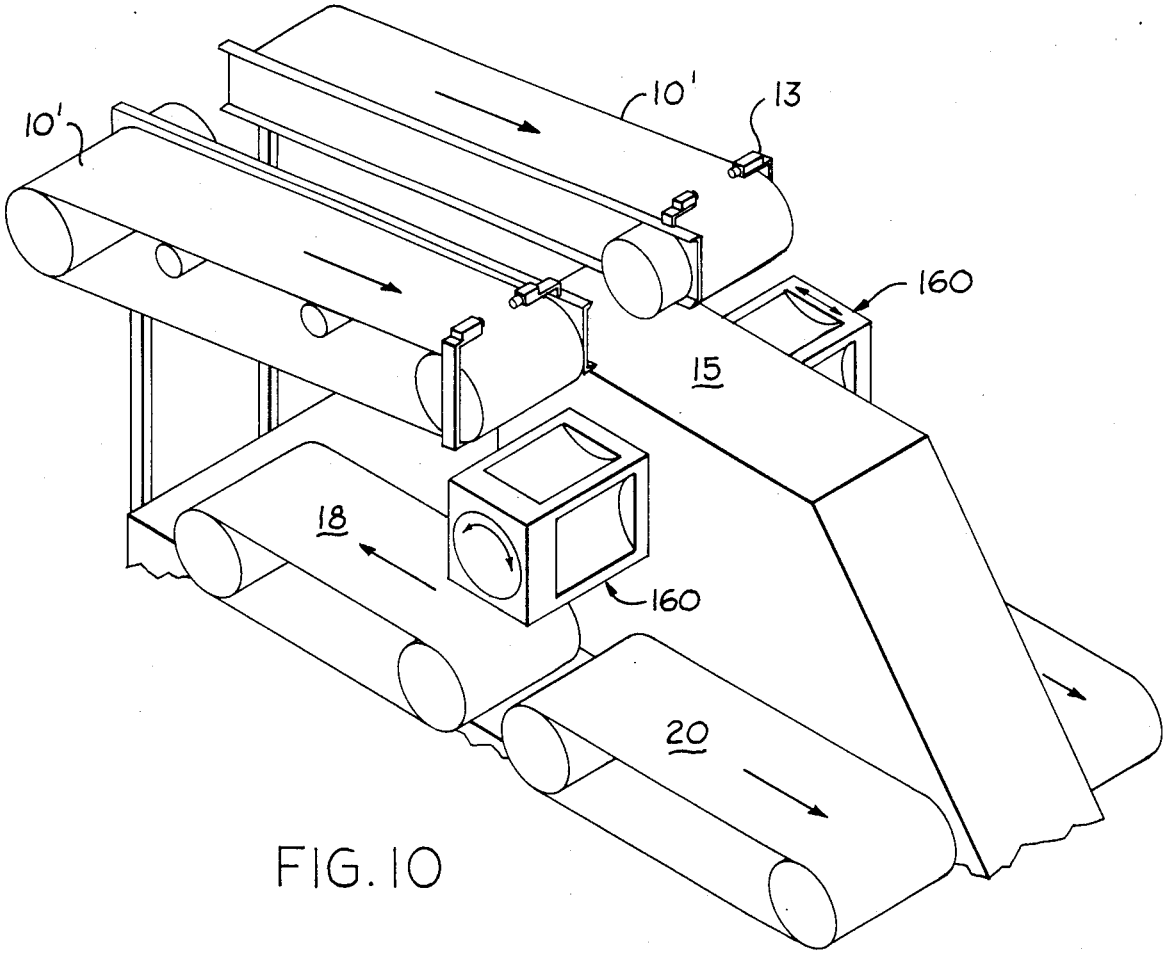
FIG. 10 is a perspective view of an apparatus similar to that shown in FIGS. 3 and 4 but with a weighing block substituting for the bi-directionally driven weighing conveyor of the embodiment of FIGS. 3 and 4.
Figure 12:
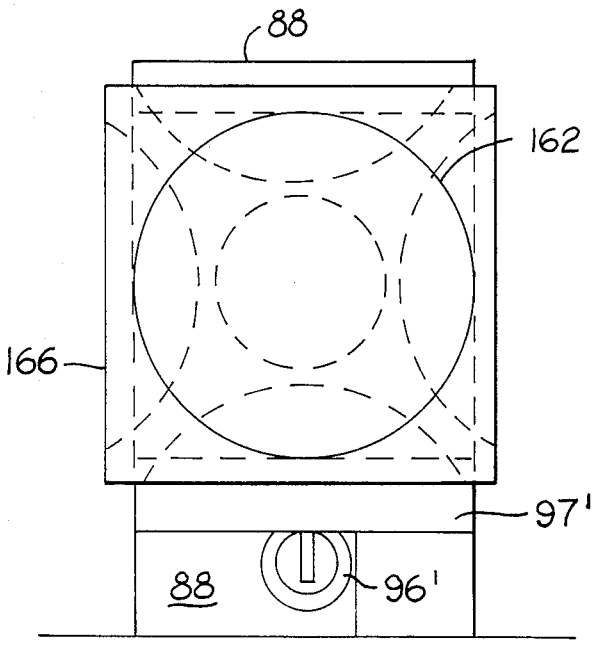
FIG. 12 is an end view of the weighing block shown in FIG. 11.
Figure 11:
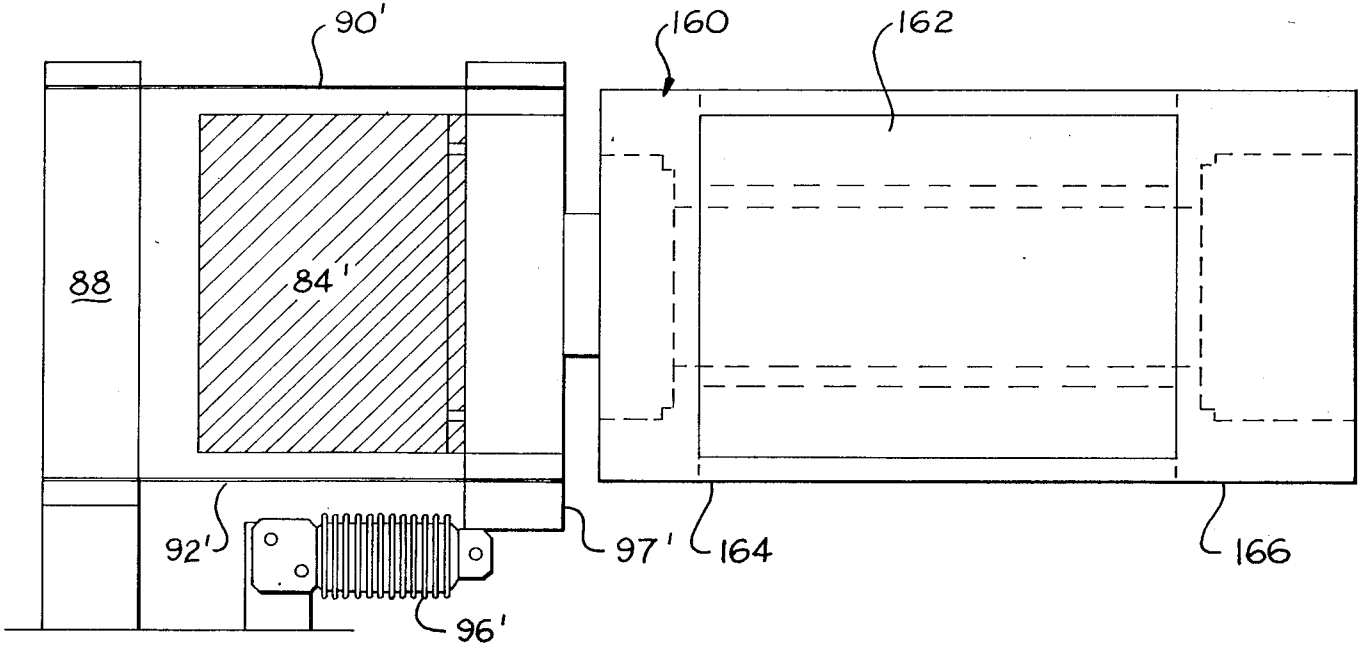
FIG. 11 is a detailed side view of the weighing block illustrated in FIG. 10.

Referring now to FIGS. 10, 11 and 12, in these figures is shown an alternative weighing device to the bi-directionally driven conveyor 16 as described above. As seen in FIG. 10, the apparatus is substantially the same as that shown in FIGS. 3 and 4 except for the addition of proximity sensor 13 and the substitution of weigh blocks 160 for the bi-directionally driven conveyor 16 in FIG. 3. It will be understood, of course, that weigh blocks 160 can be used in either embodiment of the invention. It should also be understood that in FIGS. 10, 11 and 12 that like parts or common parts to those of the previous embodiments will be identified by like reference characters.

As noted, bi-directionally driven conveyors 16 has been replaced in this embodiment with a bi-directionally driven block 160. Block. 160 is generally square with four concave surfaces which are adapted to receive an item from one of the supply conveyors. As with conveyor 16, weigh block 160 is supported from a housing or support block 88 by flex plates 90' and 92'. Weigh block 160 comprises an end 164 and 166 at four concave surfaces 162. Weigh block 160 is driven by motor 84' ninety degrees in either direction depending on the weight of the item deposited thereon. For example, should supply conveyor 10 deposit an item designated for conveyor 20, the weight of this item will cause a signal to be sent to the computer which, in turn, will cause motor 84' to turn weigh block 160 ninety degrees in the clockwise direction as seen in FIG. 12. Should the next item deposited onto the weigh block 160 also be of a weight which would send it to conveyor 20, weigh block 160 will again be moved ninety degrees in the clockwise direction.

As was the case with weigh apron 16, weigh block 160 and its support apparatus and motor 84' are supported by flex plates 90' and 92' and extend into contact with load bar 97. Thus, items deposited on weigh block 160 are weighed in exactly the same manner as they were with regard to weigh apron 16, but weigh block 160 offers the advantage of requiring only a ninety degree rotation of the weigh block to deposit the items onto the appropriate conveyor. This results in increased speed of operation for the entire machine.

It will be understood, of course, that while the form of the invention herein shown and described constitutes a preferred embodiment of the invention, it is not intended to illustrate all possible forms of the invention. It will also be understood that the words used are words of description rather than of limitation, and that various changes may be made without departing from the spirit and scope of the invention herein disclosed and illustrated.

What is claimed is:

1. An apparatus for sorting items according to detectable characteristics, comprising:

a detector for detecting predetermined characteristics of items;

an elongated conveyor for conveying items to be sorted to said detector;

a plurality of receivers disposed to receive said items after they are sorted;

a distributor disposed to receive said items and for distributing said items to said receivers, said distributor comprising:

a bi-directionally driven conveyor disposed in a fixed orientation to receive and discharge said items; and a pair of driven conveyors associated with said bi-directionally driven conveyor, one of which is disposed to receive items when said bi-directionally driven conveyor is driven in one direction and the other of which is disposed to receive items when said bi-directionally driven conveyor is driven in the other direction and wherein each of said pair of conveyors is associated with at least one receiver, and is driven to transport items received from the bi-directionally driven conveyor to a receiver associated with it; and means connected to drives for each of said conveyors for selectively driving each of said conveyors in directions responsive to the predetermined characteristics of an item detected by said detector so as to define a path from said detector to the receiver designated for items having said predetermined characteristics.

2. The sorting apparatus as set forth in claim 1 wherein the characteristic of the items detected is its wieght and wherein the detector is a weighing device to weigh such items.

3. The sorting apparatus as set forth in claim 2 wherein the weighing device is a part of the bi-directionally driven conveyor.

4. The sorting apparatus as set forth in claim 3 wherein siad bi-directionally driven conveyor is supported so as to generate a signal corresponding to the weight of items deposited on said bi-directionally driven conveyor and means for transmitting said signal to a computer means which generates a signal in response to the weight of items deposited on said bi-directionally driven conveyor to drive each of the driven conveyors in a direction which will carry said items to the receiver predetermined to receive items of the weight detected.

5. The sorting apparatus as set forth in claim 2, wherein the weighing device comprises a bi-directionally driven weigh block.

6. The sorting apparatus as set forth in claim 2 further comprising computer control means having a plurality of output terminals; each of said output terminals being connected to drive a driven conveyor, responsive to a signal being produced by said computer control means indicating the receiver into which the item is to be deposited.

7. The sorting apparatus as set forth in claim 1 wherein the distributor comprises a weighing device combined with said bi-directionally driven conveyor and one additional bi-directionally driven conveyor for each pair of receivers whereby one receiver receives items from said additional conveyor when said additional conveyor is driven in one direction and the other receiver receives items from said additional conveyor when said additional conveyor is driven in the other direction and said additional conveyor is disposed to receive items form said combining device and bi-directionally driven conveyor.

8. The sorting apparatus as set forth in claim 1 wherein the means connected to the drives for the driven conveyors comprises a computer adapted to receive signals from the detector and in response thereto to generate signals to selectively drive the drive motors for each of the conveyors so as to cause the item detected to follow a predetermined path to a predetermined receiver.

9. The sorting apparatus of claim 8 wherein said computer includes means for generating and directing a signal to a display mechanism which will indicate the weight of all of the items deposited in each receiver.

10. An apparatus for sorting items according to detectable characteristics of items comprising;

a detector for detecting predetermined characteristics of items;

an elongated conveyor for conveying said items to be sorted;

a plurality of receivers disposed to receive said items after they are sorted;

a distributor disposed to receive said items and for distributing said items to said receivers, said distributor comprising:

a first bi-directionally driven conveyor disposed to receive said items; and a pair of bi-directionally driven conveyors associated with said first bi-directionally driven conveyor, one of which is disposed to receive items when said first bi-directionally driven conveyor is driven in one direction and the other of which is disposed to receive items when said first bi-directional conveyor is driven in the other direction and wherein each of said pair of conveyors is associated with two of said receivers, one of which is disposed to receive items when its associated conveyors is driven in one direction and the other of which is disposed to receive items when its associated conveyor is driven in the other direction; and means connected to drives for each of said bi-directionally driven conveyors for selectively driving each of said bi-directionally driven conveyors in directions responsive to the predetermined characteristics of an item detected by said detector so as to define a path from said detector to the receivers designated for items having said predtermined characteristics.

11. An apparatus for sorting items according to predetermined characteristics, comprising:

a detector for detecting characteristics of items to be sorted;

an elongated conveyor for conveying said items;

a plurality of receivers disposed to receive said items after they are sorted;

a distributor disposed to receive said items and for distributing said items to said receivers whereby said items with common predetermined characteristics will be distributed to the same receiver, said distributor comprising:

a first bi-directionally driven conveyor disposed to receive all of said items;

a pair of uni-directionally driven conveyors, one of which is disposed to receive items from said first bi-directionally driven conveyor when it is driven in one direction and the other of which is disposed to receive items from said first bi-directionally driven conveyor when it is driven in the other direction;

a second bi-directionally driven conveyor associated with each of said pair of unidirectionally driven conveyors for receiving all items conveyed by its associated unidirectionally driven conveyor;

a third pair of bi-directionally driven conveyors associated with each of said second bi-directionally driven conveyors, one of which is disposed to receive items therefrom when its associated bi-directionally driven conveyor is driven in one direction and the other of which is disposed to receive items therefrom when its associated bi-directionally driven conveyor is driven in the other direction and each of said third pair of bi-directionally driven conveyors is associated with two of said receivers, one of which is disposed to receive items from its associated conveyor when said conveyor is driven in one direction and the other of which is disposed to receive items from said associated conveyor when it is driven in the other direction; and means connected to the drive for each of said bi-directionally driven conveyors for selectively driving each of said bi-directionally driven conveyors in directions responsive to the predetermined characteristics of an item detected by said detector so as to define a path from said detector to the receiver designated for items having said predetermined characteristics.

12. An apparatus for sorting items according to detectable characteristics, comprising:

(a) an elongated conveyor for conveying items to be sorted;

(b) a pluraity of receivers disposed to receive said items after they are sorted;

(c) a distributor disposed to receive said conveyed items and for distributing said items to said receivers according to detectable characteristics, comprising:

(1) a bi-directionally driven conveyor disposed in a fixed orientation to receive said items from said elongated conveyor and discharge said items;

(2) means for detecting predetermined characteristics of said items; and (3) a pair of driven conveyors associated with said bi-directionally driven conveyor, one of which is disposed to receive items when said bi-directionally driven conveyor is driven in one direction and the other which is disposed to receive items when said bi-directionally driven conveyor is driven in the other direction and each of said pair of conveyors is associated with at least one receiver for conveying items received from said bi-directionally driven conveyor to a predetermined receiver; and (d) means connected to drives for each of said conveyors for selectively driving each of said conveyors in directions responsive to the predetermined characteristiscs of an item detcted by said means for detecting so as to define a path from said means for detecting to the receiver designated for items having said predetermined characteristics.

13. The sorting apparatus as set forth in claim 12, wherein the chracteristic of the items detected is its weight and wherein the means for detecting is a weighing device to weigh such items.

14. The sorting apparatus as set forth in claim 13, wherein the weighing device is a part of the bi-directionally driven conveyor.

15. The sorting apparatus as set forth in claim 14, wherein said bi-directionally driven conveyor is supported so as to generate a signal corresponding to the weight of items deposited on said bi-directionally driven conveyor and means for transmitting said signal to a computer means which generates a signal in response to the weight of items deposited on said bi-directionally driven conveyor to drive each of the driven conveyors in a direction which will carry said items to the receiver predetermined to receive items of the weight detected.

16. The sorting apparatus as set forth in claim 13, wherein the weighing device comprises a bi-directionally driven weighing block.

17. The sorting apparatus as set forth in claim 13 further comprising computer control means having a plurality of output terminals, each of said output terminals being connected to drive a driven conveyor responsive to a signal being produced by said computer control means indicating the receiver into which the item is to be deposited.

18. The sorting apparatus as set forth in claim 12, wherien the distributor comprises a weighing device combined with said bi-directionally driven conveyor and one additional bi-directionally driven conveyor for each pair of receivers whereby one receiver receives items from said additional conveyor when said additional conveyor is driven in one direciton and the other receiver receives items from said additional conveyor when said additional conveyor is driven in the other direction and said additional conveor is disposed to receive items form said combined weighing device and bi-directionally driven conveyor.

19. An apparatus for sorting items according to detectable characteristics, comprising:

(a) an elongated conveyor for conveying said items to be sorted;

(b) a plurality of receivers disposed to receive said items after they are sorted;

(c) a distributor disposed between said elongated conveyor and said receivers for receiving items from said elongated conveyor and for selectively distributing said items to predetermined receivers, comprising:

(1) a bi-directionally driven conveyor disposed in a fixed orientation to receive and discharge said items;

(2) detecting means associated with said bi-directionally driven conveyor for detecting predetermined characteristics of said items; and (3) a pair of driven conveyors associated with said bi-directionally driven conveyor, one of which receives items conveyed when said bi-directionally driven conveyor is driven in one direction and the other of which receives items conveyed when said bi-directionally driven conveyor is driven in the opposite direction, and which are driven to transport items received from said bi-directionally driven conveyor to a preselected receiver; and (d) means connected to drives for each of said conveyors for selectively driving each of said conveyors in directions responsive to the predetermined characteristics of an item detected by said detecting means so as to define a path from said detecting means to the receiver designated for items having predetermined characteristics.

* * * * *

UNITED STATES PATENT AND TRADEMARK OFFICE

CERTIFICATE OF CORRECTION

PATENT NO. : 4,765,488

DATED : August 23, 1988

INVENTOR(S) : Larry J. Moriarty

It is certified that error appears in the above-identified patent and that said Letters Patent is hereby corrected as shown below:

On the Title Page, Item [76], "Larry J. Moriarity" should read --Larry J. Moriarty--.

Signed and Sealed this

Thirteenth Day of June, 1989

*Attest:*

DONALD J. QUIGG

*Attesting Officer*

*Commissioner of Patents and Trademarks*